US007758369B2

(12) United States Patent
Miller et al.

(10) Patent No.: US 7,758,369 B2
(45) Date of Patent: Jul. 20, 2010

(54) PLUG CONNECTOR FOR USE WITH A RECEPTACLE

(75) Inventors: Keith Edwin Miller, Manheim, PA (US); William David Irwin, Elizabethtown, PA (US); Timothy M. Beck, York Haven, PA (US); Navin Kanjibhai Patel, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/109,681

(22) Filed: Apr. 25, 2008

(65) Prior Publication Data

US 2009/0269962 A1 Oct. 29, 2009

(51) Int. Cl.
*H01R 13/627* (2006.01)

(52) U.S. Cl. ..... 439/352; 439/909; 439/490; 439/910

(58) Field of Classification Search ..... 439/352, 439/357, 358, 490, 680, 909, 910, 924.1, 439/188

See application file for complete search history.

(56) References Cited

U.S. PATENT DOCUMENTS 3,399,374 A * 8/1968 Pauza et al. ..... 439/355
4,084,875 A * 4/1978 Yamamoto ..... 439/274
4,458,973 A 7/1984 Hayes et al.
4,572,602 A 2/1986 Rupnik
5,509,823 A 4/1996 Harting
5,967,817 A 10/1999 Greenstein
5,997,343 A 12/1999 Mills
6,048,218 A 4/2000 Greenstein
6,106,338 A 8/2000 Wu et al.
6,113,413 A 9/2000 Cronin et al.
6,165,005 A 12/2000 Mills
6,234,816 B1 5/2001 Greenstein
6,244,882 B1 6/2001 Greenstein
6,257,914 B1 7/2001 Comerci et al.
6,259,170 B1 7/2001 Limoge
6,280,213 B1 8/2001 Tobler
6,319,031 B1 11/2001 Greenstein
6,346,014 B1 2/2002 Griesser
6,361,357 B1 3/2002 Stillwell et al.
6,364,687 B1 4/2002 Chen
6,431,901 B1 8/2002 Yeh (Continued)

OTHER PUBLICATIONS

Search Report for International Application No. PCT/US2009/001511, mailed Jul. 29, 2009.

*Primary Examiner*—Tho D Ta

(57) ABSTRACT

A plug connector for use with a receptacle. The plug connector and receptacle combination may prevent more than one use of the single use plug connector, thereby necessitating disposal of the plug connector and associated, disposable, specialized instrumentation to which the plug connector is connected. The plug connector may be keyed and otherwise identified to the receptacle by shape, tactile indicia and visual indicia so that it cannot be mistakenly used with a different receptacle, while providing proper orientation for rapid assembly. When designed for single use or limited multiple use, the insertion of the plug connector into the receptacle moves a jumper contact in the plug connector from a first position to a second position where it is captured. The receptacle and plug connector may include an interface for a light pipe and a light path that illuminates the plug connector to facilitate assembly and disassembly in areas in which light is limited, such as operating rooms, as well as communicating information to the user.

16 Claims, 6 Drawing Sheets

U.S. PATENT DOCUMENTS

| | | | | |
|---|---|---|---|---|
| 6,457,987 | B1 | 10/2002 | Yeh | |
| 6,561,834 | B2 * | 5/2003 | Chen | 439/358 |
| 6,714,809 | B2 | 3/2004 | Lee | |
| 7,014,491 | B1 | 3/2006 | Simmel | |
| 7,077,684 | B2 | 7/2006 | Sasame | |
| 7,247,046 | B1 | 7/2007 | Wu | |
| 7,300,313 | B1 * | 11/2007 | Whiteman et al. | 439/680 |
| 7,481,664 | B1 * | 1/2009 | Knoll et al. | 439/359 |
| 2005/0032415 | A1 * | 2/2005 | Sakamoto | 439/490 |
| 2008/0003867 | A1 | 1/2008 | Wu | |

* cited by examiner

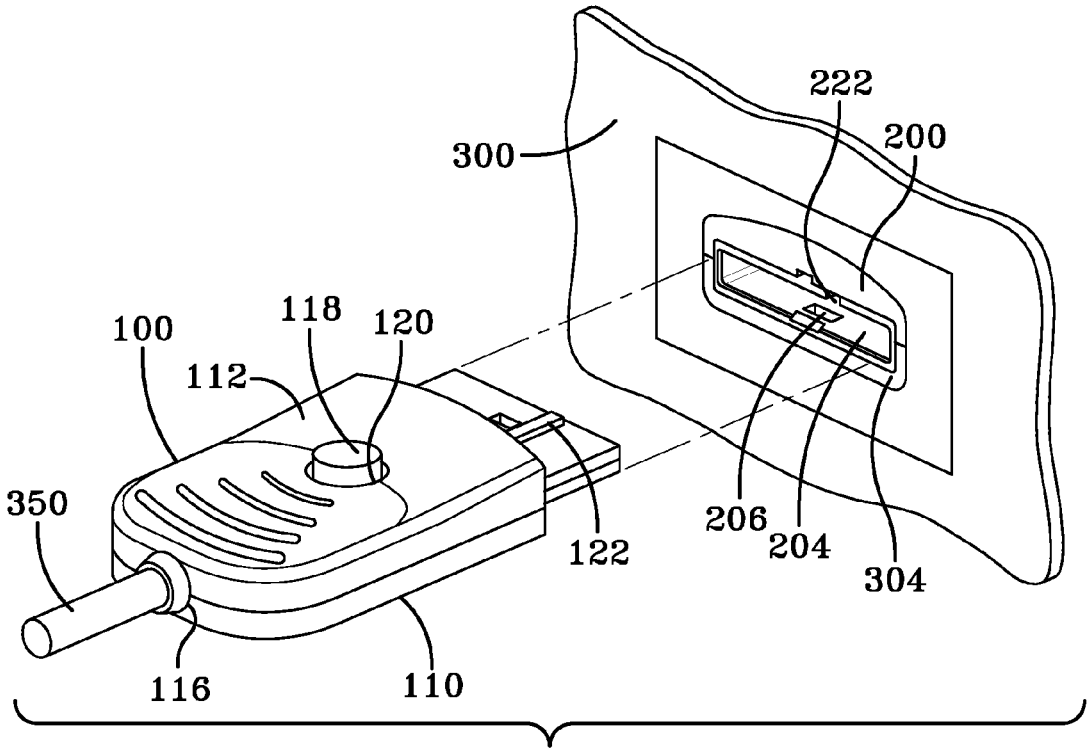
FIG-2
FIG-3
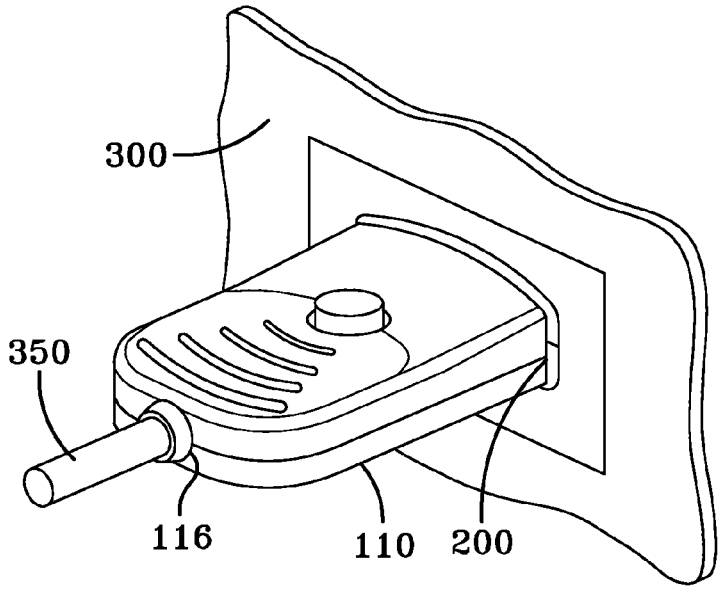

PLUG CONNECTOR FOR USE WITH A RECEPTACLE

FIELD OF THE INVENTION

The present invention is directed to a plug connector and receptacle combination for use with complex equipment, and in, particular, for use with equipment used for medical and dental applications.

BACKGROUND OF THE INVENTION

Because of various safety and sanitary concerns, instruments and equipment used for various dental and medical procedures are utilized for a single patient or a single event and then are disposed of or sterilized prior to reuse. However, not all equipment can or should be disposed of after a single use because of its sophistication and associated expense. This equipment may include delicate electronic instrumentation that monitors various patient conditions and should be reused. Such equipment may be isolated from biohazards because of its expense and inability to be sterilized after such an exposure. This type of equipment is to be distinguished from what is referred to herein as instrumentation, which may be complex, but which cannot be sterilized or, if sterilizable, may decrease in function after a preselected number of uses. As set forth herein, the instrumentation is connected to equipment, the equipment having a much longer design life than the instrumentation, which may have an intended life of a single use.

Even though the sophisticated equipment may be reused, a portion of the equipment is designed for a single use and is intended to be discarded. This equipment frequently is brought into contact with the patient or is in the vicinity of the patient, but need not be so restricted. This portion of the equipment may include a plug connector with a cable assembly that is attached to disposable instrumentation. The plug connector and cable assembly provide a connection between the disposable instrumentation and the sophisticated electronic equipment. The plug connector interfaces with a receptacle, as the combination, a connector, that is connected or wired to the expensive monitoring equipment.

Although the intended instrumentation is intended for a single use, there is always a possibility that the disposable instrumentation is not discarded, and is reused. What is needed is disposable instrumentation that includes features that may prevent reuse and may necessitate disposal, thereby providing a safeguard against reuse, either inadvertent or intentional.

Another desirable feature in a connector includes the ability to be easily and inexpensively terminated to a cable and assembled in an orientation that makes assembly easier. Many existing medial connectors utilize solder terminations in a tight contact configuration, making crimped contact termination of the cable to the connectors difficult. Thus, a medical connector that includes an orientation that permits access for crimped termination of cable to contacts is also desirable.

An assembly of a male part, such as a plug connector to a female part, such as a receptacle, desirably should be easy to mate. This desirably can be accomplished by selecting a shape of the mating parts so that it is clear by visual inspection how the parts should be properly mated. Visual inspection can also aid in assembly by color coding the male part to the female part or receptacle, by custom coloring the parts to assist in assembly. Furthermore, tactile features can also assist in determining proper orientation of a plug, which also can be useful in low light situations when visibility is impaired.

A plug connector/receptacle assembly that incorporates several of these features would facilitate its manufacturing and assembly for medical uses and make it adaptable for single use applications, if desired.

SUMMARY OF THE INVENTION

The present invention provides a plug connector for use with a receptacle that can be adapted for single use applications. The plug connector and receptacle combination, when so adapted, prevent more than one use of the single use plug connector, thereby necessitating disposal of the plug connector and associated, disposable, specialized instrumentation to which the plug connector is connected. The plug connector may be keyed or otherwise identified to the receptacle so that it cannot mistakenly be used with a different receptacle. The plug connector also can have a physical configuration that allows for efficient termination to a cable, making contact termination significantly easier. A configuration in which the contacts are arranged substantially in a planar configuration provides better access, allowing for cable termination by crimping rather than soldering. Contact arrangement need not be in a single plane, but may be accomplished in more than one plane with sufficient spacing between the planes to facilitate assembly of the contacts that have been crimped to wires.

The planar arrangement of the contacts also can provide a visual orientation for proper mating of the plug connector to the receptacle. Thus, by making the plug connector in a shape that makes it visually obvious as to how to mate it to the receptacle, such as by shaping the plug connector as a trapezoid which can include the planar arrangements of or other visually apparent shape and similarly shaping the receptacle with a shape that will accept the plug connector will facilitate the mating. Further, by adding visual indicia, such as a color orientation or other visual indicia such as dots, to the plug connector and mating visual indicia to the receptacle, matching the plug connector with the receptacle is facilitated by matching the visual indicia. In low light situations, visual indicia or shape matching may not be possible or may become difficult. To facilitate proper orientation of the plug connector, a tactile aid may be added to the plug connector. The tactile aid could include a feature such as ridges on one face of the plug connector so that an individual handling the plug connector, by feel, could determine the proper orientation of the plug connector with respect to the receptacle even when light would prevent use of other visual or shape indicia.

In one embodiment, the receptacle is mounted to the sophisticated medical equipment. While the sophisticated equipment can be any equipment, it is particularly suited for applications in medical or dental procedures. The receptacle may be mounted on a panel and includes spring probes. The contacts are arrayed so that they are somewhat isolated, which is to say, they are not readily accessible for handling so as to preclude inadvertent contact or damage, yet are readily accessible by a mating plug. The receptacle may be reused, and in fact, may have a high cycle life. The receptacle includes a plurality of metal spring contacts, each spring contact having a first end and a second end. The first end is configured to accept a wire and a second end is configured to mate with a corresponding metal contact, which mating contact may be positioned on a mating plug connector. Each spring contact has a first fixed length. In addition, each receptacle includes a fixed metal contact having a first end and a second end, and usually there are two or more fixed metal contacts. The fixed metal contact has a second length which may be the same as or different from the length of the spring contacts. The first end of the fixed metal contacts is configured to accept a wire, while the second end extends in the same direction as the metal spring contacts. A housing locates and align the plurality of spring contacts and the fixed contacts. The housing has a first end and a second end, the second end of the spring contacts and the fixed metal contacts extending away from the second end of the housing. Wires access the metal spring contacts and the fixed metal contact through the first end of the housing. The housing also includes means for locking a mating plug connector to prevent inadvertent disassembly.

The plug connector of the present invention is attached to instrumentation and includes a latching mechanism movable from a first engaged position to a second disengaged position. The latching mechanism further includes a latch release surface, and a means for latching the mechanism to an opposed surface. The means for latching is intended to removably attach the latching mechanism to the receptacle, which includes the opposed surface. The plug connector further includes a plurality of metal contacts, each of the contacts having a first end and a second end. Each contact includes the first end for engaging metal spring contacts located in the receptacle, and the second end configured to accept a wire. The contacts used within the plug connector are not unique, and other contacts may be used provided the plug connector includes the other unique requirements set forth herein. For example, the metal spring contacts described above as located in the receptacle may instead be used with the plug connector and the metal contacts in the plug connector may be used in the receptacle. The plug connector may include a jumper contact movable from a first position to a second position when the latching mechanism is in the first engaged position. The plug connector may include a means for capturing the jumper contact in the second position once the plug connector is inserted into the receptacle. Once captured, the jumper contact does not return to its first position, but remains in the second, captured position. The plurality of metal contacts and the optional jumper contact are located and aligned within a housing. This housing includes an exterior and an interior, with a passageway extending from the exterior of the housing to the interior of the housing. The plurality of metal contacts as well as the jumper contact are located within the housing so that they are not easily accessible, except by a mating part here the receptacle, thereby protecting them from inadvertent handling and potential damage. A wire may be inserted from the exterior of the housing through the passageway into the interior of the housing, where the wire can be assembled to the metal contacts. The opposite end of the wire is connected to the metal contacts.

Disposable instrumentation may be attached to the plug connector, however the plug connector is not restricted as to what it may be used with. The plug connector is inserted into the receptacle with the jumper contact in its first position. As the plug connector is further inserted into the receptacle, the jumper contact interfaces with the fixed metal contacts, urging the jumper contact toward its second position. The contact of the jumper contact to the fixed metal contact allows the transmission of a signal through the fixed metal contacts. This signal indicates the presence of the jumper contact, which is indicative of a first use of the attached instrumentation. When the plug connector is fully inserted into the receptacle, the fixed contacts urge the jumper contact into its second position, where it is captured within the plug connector. Once captured by the plug connector, the jumper contact is not readily released from its captured position without disassembly of the plug connector or without the use of the special tool. Also, full insertion causes the latching mechanism to move into its first engaged position, where it is captured in the receptacle by the means for locking in the receptacle. The plug connector may be released from the receptacle by moving the latching mechanism to a second position so that it may be disengaged, allowing the plug connector to be removed from the receptacle. However, removal of the plug connector from the receptacle does not affect the jumper contact, which is captured in its second position. Since the jumper contact is captured in its second position, reinsertion of the plug connector into a mating receptacle will not provide a contact with the fixed contact prior to the other contacts, so that a signal indicating a first use of the plug is not provided. The equipment can be programmed as appropriate to respond to the reinsertion of such a plug connector into the mating receptacle.

An advantage of the present invention is that the plug connector can provide an effective way to avoid a reuse of instrumentation designed for a single use. The plug connector can be provided for single use and made inexpensively, connected to the disposable instrumentation, and can be disposed of with the disposable instrumentation, if so desired.

Another advantage of the present invention is that the plug connector is easily mated to and unmated from the sophisticated medical equipment so that any protective gloves do not have to be removed, and is readily locked into place to prevent inadvertent disassembly. Furthermore, when single use is intended, full assembly of the plug contact into the mating receptacle captures the jumper contact into its second position, and further use of the plug connector does not result in movement of the jumper contact from its captured position.

Another advantage of the combined plug connector and mating receptacle is that the receptacle attached to the sophisticated equipment has a high cycle life, so that it can be reused significantly. The plug connector may be restricted substantially to a single use on insertion into a mating receptacle, if so desired.

Still another advantage of the combined plug connector and mating receptacle having a jumper contact is that the combination provides a signal indicative of the presence of a new plug connector, or at least a plug connector not previously inserted into a mating receptacle, and the sophisticated equipment can be programmed in a number of ways to react to the presence of a plug connector mated to the receptacle and the presence or absence of a signal indicative of a new or not previously used plug connector.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 2 depicts the plug connector prior to mating to a receptacle located in a panel of equipment.

FIG. 3 depicts the plug connector mated to the receptacle and panel of FIG. 2.

FIG. 4A depicts the plug connector in which a plug cover is removed from the plug assembly, while

DETAILED DESCRIPTION OF THE INVENTION

The present invention is depicted in FIG. 1, delineating a plug connector/receptacle assembly 10 of the present invention. The assembly having a plug connector 100 fitted to a receptacle 200. Such a plug connector optionally provides for plug connector 100 that can provide a single use, or be limited to a predetermined number of uses due to other factors such as the addition of electronics.

Figure 1A:
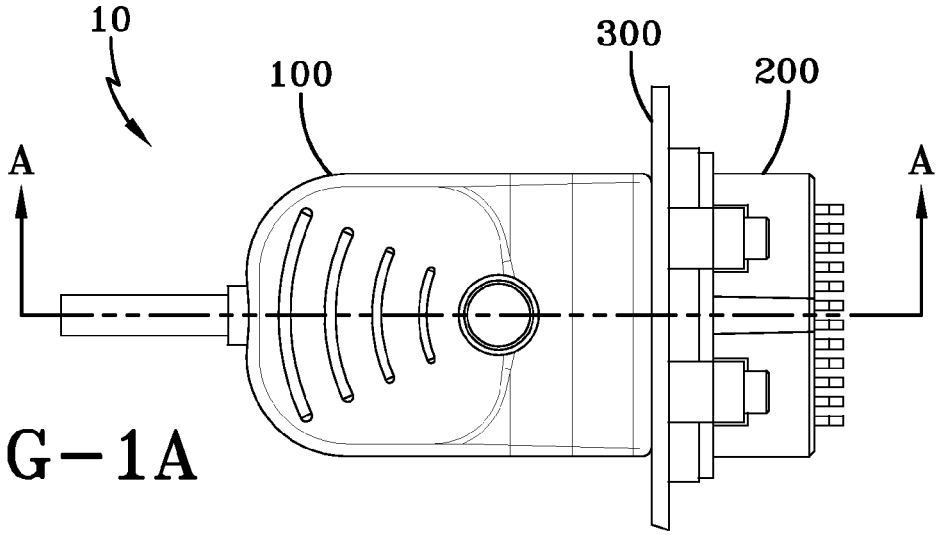
FIGS. 1(*a*), (*b*) and (*c*) depicts an assembly of the present invention with the plug connector inserted into a receptacle, viewed from the top, and in cross-section with the plug connector in the latched and unlatched position.
Figure 1B:
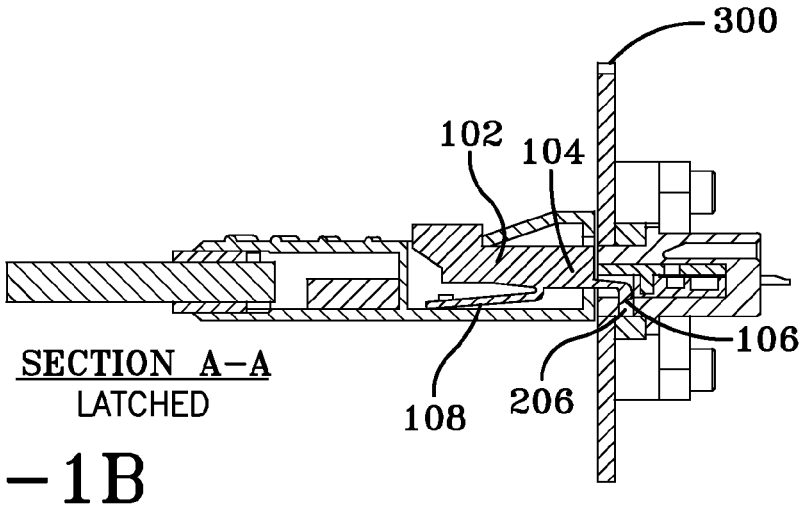
Figure 1C:
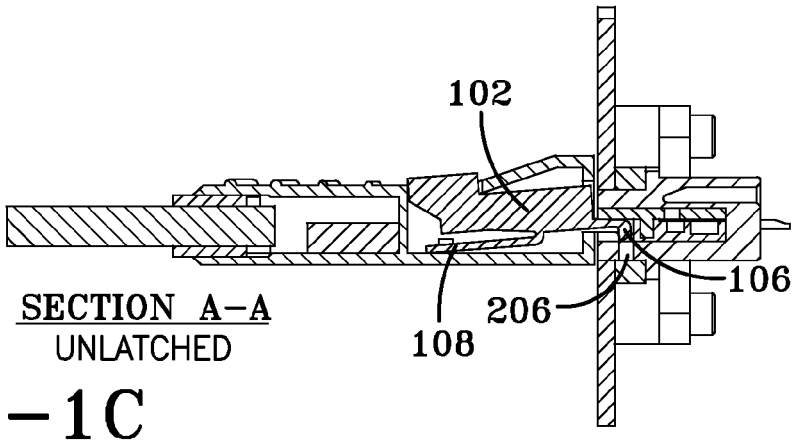

FIG. 1A depicts a top view of assembly 10, while FIG. 1B depicts a sectional view along section A-A of assembly 10 with plug connector 100 mated to receptacle 200 in the latched position. FIG. 1C depicts a sectional view along section A-A of assembly 10 with plug connector mated to receptacle 200 in the unlatched position. FIG. 1 depicts plug connector 100 as having a rectangular section at the end at which it mates with receptacle 200 and a somewhat rounded end opposite receptacle 200. This is a preferred geometry, and the shape of plug connector is not so limited. It is preferred, however, that the size and shape plug connector 100 is such that it is comfortably held in the hand of the user so that it is readily assembled to the receptacle. This is important because assembly may be required in low-light situations in which visibility is impaired, or in high stress situations in which rapid positive engagement is required. To further assist in making such positive engagement, the shape of plug connector 100 and receptacle 200 can be molded so that it can be determined visually that there is but a single way to assemble them together. An exemplary embodiment is a plug connector having a trapezoidal shape forming the male side of the connection, and a receptacle having a female shape forming the female side of the connection. Any other similar mating shapes could be used.

Referring to FIG. 1B, a latching member 102 is depicted which includes a latching arm 104. Latching arm 104 includes a means for latching 106 that extends through equipment panel 300 and cooperates with a means for locking 206 in receptacle 200, more clearly shown in FIG. 1C, to lock plug connector 100 to receptacle 200. As depicted in FIG. 1B, means for latching 106 is a projection that extends downward from latching arm 104 after passing through equipment panel 300 and is captured in means for locking 206, depicted as an aperture in FIG. 1C. While means for latching 106 is depicted as a downwardly extending projection that interfaces with the means for locking 206, the means for latching 106 may be any known latching device that interfaces with a means for locking 206 to lock plug connector 100 to receptacle 200. For example a projection may extend from receptacle 200, the receptacle being removably captured by plug connector 100. As a further example, means for latching 106 may be a pair of horizontally oriented arms biased in an outward position that extend through equipment panel 300. The horizontally oriented arms may be squeezed together against the bias to move the arms to an inward position so that they can be inserted through an aperture in equipment panel 300. Release of the arms would bias the arms outwardly, locking them in receptacle or alternatively, against the back of equipment panel 300. Release is accomplished by squeezing the arms together again. While removably locking plug connector 100 to receptacle 200 is an important feature of the present invention, any other removable locking mechanism may be employed.

Referring back to FIGS. 1B, latching mechanism further includes a latch compression arm 108 that provides a bias maintain means for latching 106 into a normal engaged position, in this embodiment, downward. Referring to FIG. 1C, application of a force to latching member 102 that compresses latch compression arm 108 moves means for latching 106 to a position allowing it to be disengaged, in this embodiment, upward.

FIG. 2 depicts receptacle 200 assembled to an equipment panel 300, and a plug connector 100 spaced from equipment panel 300. In the embodiment shown in FIG. 2, plug connector 100 further includes a housing 110 and a cover 112. When cover 112 and plug housing 110 are assembled they form an aperture 116 that provides a path to the interior of the assembly. A cable 350 or wire passes through aperture 116 and to the interior of plug connector 100. A release button 118, which in this embodiment is part of latching mechanism 102, projects through an aperture 120 in cover 112. Application of force to release button 118 compresses latch compression arm 108 to move the projection, in this embodiment the means for latching 106, upward into a disengaged position. The plug connector has a distinctive shape driven by the contrast of the flat, feature free exterior of plug housing 110 and the curved, blended surfaces of cover 112. The cover 112 further has raised ridges and the latch button 118 extending from the surface. These physical features are designed to provide a tactile guide for proper orientation of the plug. The plug housing 110 and the cover 112 may also be different colors to aid in visually orienting the plug assembly 100 with a two tone label 304 installed on the equipment panel 300 around receptacle assembly 200. Plug connector 100 further includes a key 122 which mates with a keyway 222 in receptacle 200. This key 122/keyway 222 combination assures that only the appropriate plug connector applied to the appropriate instrumentation can be assembled into receptacle 200, which is assembled to the sophisticated equipment. This key/keyway combination is unique to an instrumentation/equipment combination and assures that the appropriate instrumentation is connected to the appropriate sophisticated equipment. Although shown as a rectangular key and keyway, the key/keyway combination may assume any geometric configuration and may be positioned at different locations along plug connector 100 and receptacle 200. Another advantage of the key/keyway combination is that it assures that the plug connector 100 is properly mated to receptacle 200.

FIG. 2 also shows a latching surface 204 that includes the means for locking 206. As noted above, the means for locking 206 in receptacle 200 must cooperate with the means for latching 106 in plug connector 100. In this embodiment, latching surface 204 includes as a means for locking 206 an aperture, which captures the means for latching 106, which in this embodiment is a downwardly oriented projection.

FIG. 3 depicts a plug connector 100 mated to a receptacle 200, which in turn is assembled to equipment panel 300. Cable 350 is shown assembled to plug connector 100, passing through aperture 116.

Figure 4A:
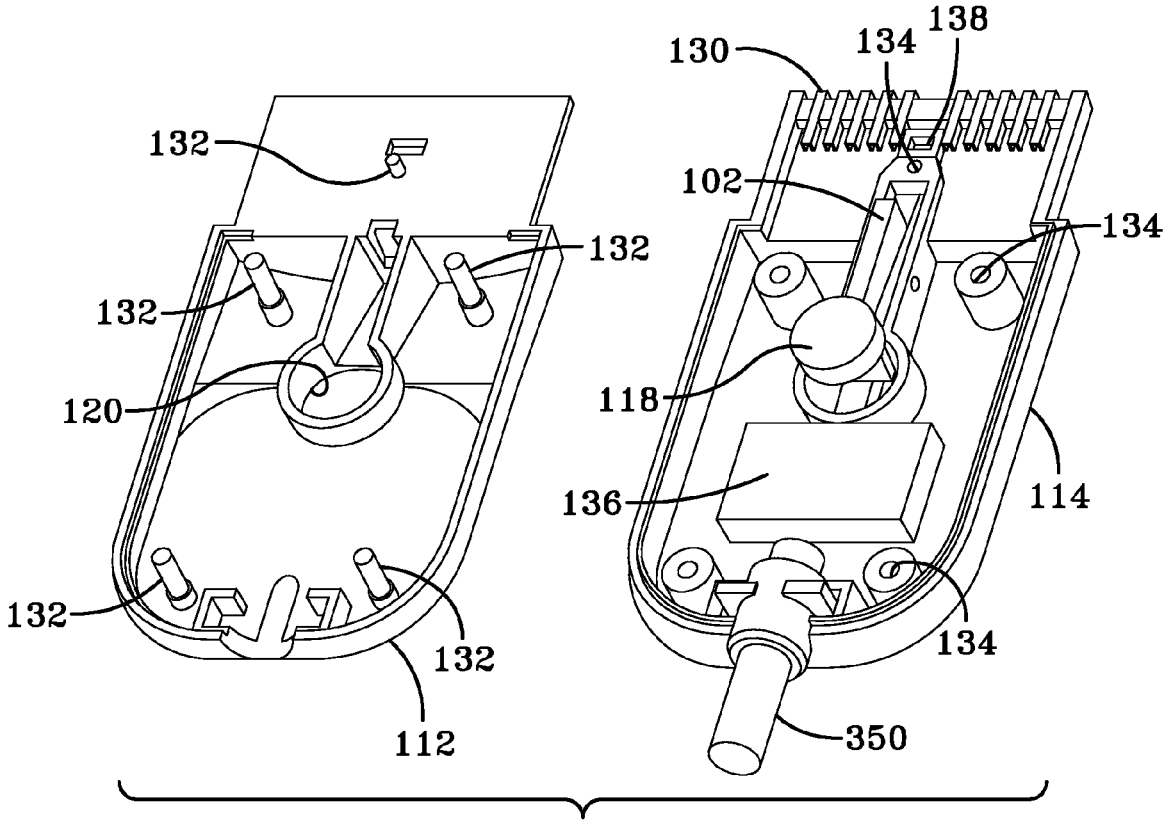

Referring now to FIG. 4A, depicting the plug connector 100 which is disassembled by removing the plug cover 112, thus disclosing the interior of the plug connector. A cable 350 is shown assembled to housing 110 extending from its exterior to its interior. A plurality of metal contacts 130 are located in the plug assembly spaced from cable 350. Cable 350 is not part of plug connector, but provides communication from instrumentation attached to its opposite end to the sophisticated equipment through plug connector 100 and receptacle 200 to the sophisticated electronic equipment. Although not shown in FIG. 4A, the cable is made up of individual wires, the individual wires are contained within the interior of housing 110 and connected to individual contacts 130 of the plurality of contacts. The plurality of individual contacts are oriented in a planar arrangement. This facilitates connection to the individual wires of the cable by crimping. The arrangement of the contacts in a single plane provides sufficient access to assemble the contacts after forming a reliable crimp joint to the individual wires. Although shown in a single plane, the contacts may be arranged in two parallel planes, if sufficient space is provided for assembly. This eliminates the need to provide solder connections between the individual wires and the contacts, which previously was required because of limited access to closely oriented contacts. Also depicted is latching mechanism 102 positioned within plug assembly 100, with release button 118 extending upward. Cover 112 includes aperture 120 through which release button 118 extends when cover 112 and plug housing 110 are assembled. To facilitate this assembly, cover 112 includes a plurality of alignment retention posts 132 that mate with alignment retention holes 134 in plug housing 110, posts 132 snapping into holes 134 to provide positive engagement. Any other convenient method for assembling cover 112 to plug housing 110 may be substituted for the post/hole arrangement. Also shown is an area 136 that is reserved for electronics. Whether or not additional electronics is required and the details of such electronics are dependent on the specific application. Any wiring when such electronics is included would likely originate from the cable, but such details would be application-specific. A jumper contact 138 is located adjacent to the plurality of contacts.

Figure 4B:
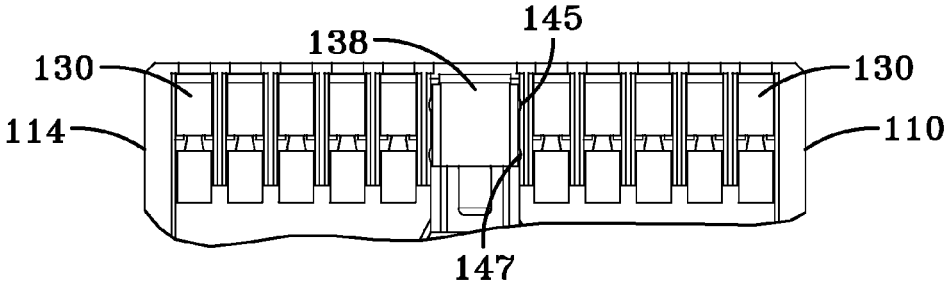
FIG. 4B depicts a cut-away section of the plug assembly with the jumper contact in a first position prior to insertion into the receptacle.

The jumper contact 138 is movable from a first position, depicted in FIG. 4B, to a second position in which it is captured. Although shown centered within the plurality of contacts 130, jumper contact 138 is designed to engage receptacle 200 and may be positioned at other locations on plug connector 100 that permit such engagement.

Figure 5:
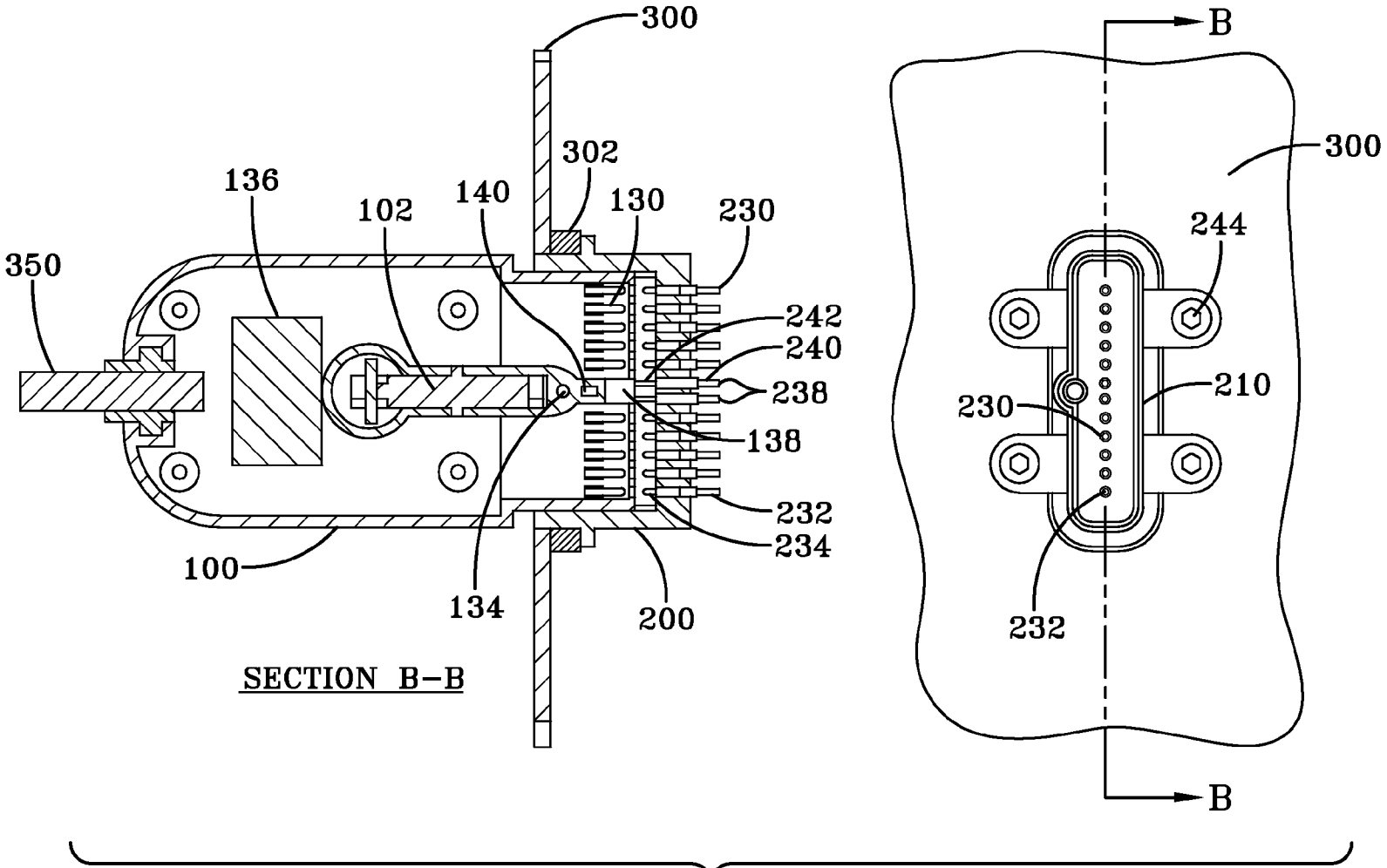
FIG. 5 is a sectional view of the plug connector partially mated to the receptacle.

FIG. 5 depicts a cross-sectional view of plug connector/receptacle assembly 10 along section B-B. In FIG. 5, plug connector 100 is partially mated into receptacle 200 through equipment panel 300, but plug connector 100 and receptacle 200 are not fully engaged. Receptacle 200 is assembled to an equipment panel 300 and secured thereto by fasteners 244. A gasket 302 is positioned as shown between receptacle 200 and equipment panel 300 to provide a seal in the opening in the equipment panel as protection from the ingress of liquid into the electronic equipment during periodic wipe-down with cleaning solutions and disinfectants such as alcohol. Receptacle 200 provides an interface with sophisticated electronic equipment to which a plug connector can be inserted. Receptacle 200 includes a plurality of metal spring contact probes 230 in a receptacle housing 210. Each of the metal spring contact probes 230 is of a first length and has a first end 232 configured to accept a wire that provides a signal to sophisticated electronic equipment, which are not shown. The second end 234 of metal spring contact probes are arranged in receptacle housing 210 so that the plurality of metal spring contact probes 230 interfaces with plurality of metal contacts 130 when plug connector 100 is assembled to receptacle 200. A pair of fixed metal contacts 238 is also shown in FIG. 5 positioned in receptacle housing 210. Fixed metal contacts 238 are located so that they abut jumper contact 138, when plug connector 100 is inserted in receptacle 200. Thus, the positions of both fixed metal contacts 238 and jumper contact 138 are predetermined within their respective housings so as to abut against each other upon mating and their respective positions are not limited to those shown in FIG. 5. In FIG. 5, fixed metal contacts 238 have a second length that is longer than the first length of metal spring contact probes 230 and have a first end 240 configured to accept a wire for communication with the electronic equipment and a second end 242 arranged in receptacle housing opposite jumper contact 138. In the depicted embodiment, the first ends 232 of plurality of spring contact probes 230 are in alignment with first end of fixed metal contacts 240, while second end of fixed metal contacts 242 extend beyond second ends 234 of spring contact probes 230 toward equipment panel 300 and plug connector 100.

Figure 4C:
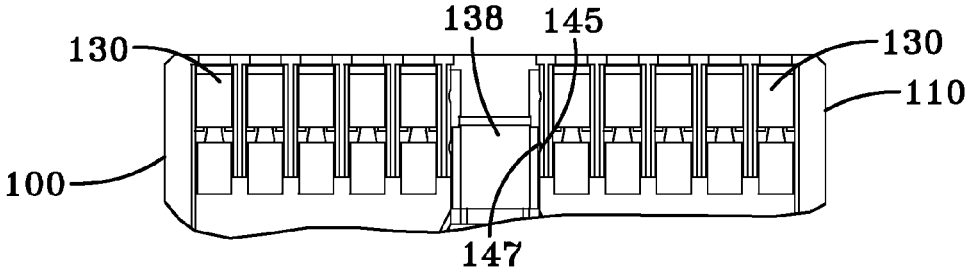
FIG. 4C depicts a cut-away with the jumper contact in a second position in which it is captured, after insertion into the receptacle.

Jumper contact 138 is movable from a first position to a second position. As shown in FIG. 5, jumper contact 138 is in its first position. Between jumper contact 138 and an alignment retention aperture 134 is a feature that is identified as a means for capturing 140 jumper contact 138, which is located within housing 110 at what is the second jumper contact position. This means of capturing 140 may be any mechanism or feature that prevents movement of jumper contact 138 once it is moved to its second position. As plug connector 100 is further inserted into receptacle 200, end 242 of fixed metal contacts 238, which extends further toward plug connector 100, initially contacts jumper contact 138, which may close a circuit, thereby allowing a signal to be sent. This signal, received before the plurality of metal contacts 130 contact plurality of spring contact probes 230, can be interpreted by appropriate algorithms or software to indicate that the plug connector is new. Continued movement of plug connector 100 into receptacle 200 further moves jumper contact 138 to its second position into alignment with means for capturing 140, where it is captured so that it can no longer return to its initial or first position. In this embodiment, means for capturing 140 is depicted as a raised block over which jumper contact 138 can move. The raised block and jumper contact 138 have dimensional tolerances so that the mating surfaces interfere with one another, jumper contact 138 being captured by the interference. However, any other arrangement that results in jumper contact 138 being captured in its second position may be used. For example, plug connector 100 may include a depression at the jumper contact second position sized to accept jumper contact 138, into which jumper contact 138 recedes or falls once it is moved into its second position. Alternatively, means for capturing may be a raised block with a biased nipple that is depressed as jumper contacts 138 moves from its first position to its second position. Jumper contact 138 includes a dimple into which biased nipple moves into once jumper contact 138 moves into its second position, thereby preventing further movement of jumper contact 138. In a preferred embodiment, depicted in FIGS. 4B, a cut-away section of the plug assembly with the jumper contact 138 in the first position prior to insertion into the receptacle is shown, and FIG. 4C, depicts a cut-away with jumper contact 138 in the second position in which it is captured, after insertion into receptacle 200. The jumper contact 138 includes a dimple 145, while plug connector 100 includes a recess 147. In the first position, before insertion of plug assembly 100 into receptacle 200, dimple 145 is spaced from recess 147. Once jumper contact 138 is moved by fixed metal contacts 238, not shown in FIG. 4C, but shown in FIG. 5, to its second position, jumper contact 138 is locked in its second position as dimple 145 is captured by recess 147, thereby preventing jumper contact 138 from returning to its first position.

The arrangement of jumper contact 138 and fixed metal contacts 238 is not limited to the arrangement shown in FIG. 5. Fixed metal contacts 238 may be the same length as metal spring contact probes 230 or may be shorter than probes 230, in which case jumper contact 138 extends further toward receptacle than the plurality of metal contacts 130. The concept is that fixed metal contacts 238 touch jumper contact 138 prior to full mating of plug connector 100 into receptacle 200 and urge jumper contact 138 into its second captured position as full mating of plug connector 100 into receptacle 200 is achieved. The touching closes a circuit sending a signal, resolvable by appropriate algorithms, indicative of the closing. The timing of the circuit closing is resolved to determine whether the plug connector 100 is new. Unmating of plug connector 100 from receptacle 200 can then be accomplished without further movement of jumper contact 138, which is captured in its second position.

Of course, full mating of plug connector 100 into receptacle 200 results in means for latching 106 being captured by means for locking 206, see FIG. 1B, thereby securing plug connector 100 into receptacle 200 and preventing inadvertent unmating. In the embodiment depicted in FIGS. 1-5, unmating can be accomplished by depressing release button 118 while withdrawing plug connector 100 from receptacle 200 as previously noted.

The fixed metal contacts 238, being wired, are in communication with the equipment. The connection of second end 242 of fixed metal contacts 238 to jumper contact 138 generates a signal, such as for example by closing a circuit. The equipment, as noted, may include an algorithm that can analyze this signal. Alternatively, the plug connector 100 may include, within the area reserved for electronics, means for preventing the plug connector from being used more than a specified number of times, such as once. Of course, after the first use, the fixed metal contacts 238 may contact jumper contact 138 on reinsertion of plug connector 100 into receptacle 200 if jumper contact 138 is captured and not moved out of the line of motion of fixed metal contacts 138. In this circumstance, the timing of the circuit closing can be resolved and the software, firmware or algorithm can "count" the number of times that plug connector 100 is inserted into receptacle 200. This information can be evaluated to limit the use of the plug connector 100 by limiting the number of insertions into receptacle 200, after which the equipment reacts. These means for preventing use more than a specified number of times may include specifically designed electronics, software or firmware. If the algorithm determines that this is the first signal received (after a reset of the equipment following removal of a prior plug connector, which reset may be automatic or manual) then the algorithm determines that a new plug connector 100 has been inserted into receptacle 200 and the equipment will respond in a normal fashion. If, on insertion of a plug connector 100 into a receptacle 200, no signal is received from the circuit that includes fixed metal contact 238 and jumper contact 138 indicating that the circuit is not closed, or a signal is received from the circuit that includes fixed metal contact 238 and jumper contact 138, after a signal indicative of installation of plug connector 100, such as by closing of a circuit that includes one or more of the plurality of spring contact probes 230 and one or more of the plurality of metal contacts 130, the algorithm will determine that plug connector 100 was previously installed into receptacle 200, and a count may be generated internally. Once this determination is made, the equipment may be programmed to respond in an appropriate way. For example, in certain applications, the equipment may be programmed not to operate at all unless a new plug connector is installed. In other circumstances, the equipment may be programmed to operate for a limited amount of time after installation of plug connector 100 that is not new. In still other cases, the equipment may permit continued operation if a plug connector 100 that has been determined to be not new is installed within a predetermined period of time after removal of a plug connector, as this may indicate inadvertent disassembly of what had been a new plug connector from the equipment. These examples are not meant to be limiting, as the equipment may be programmed to respond as desired, depending upon the application. The algorithm only allows the machine to determine whether plug connector 100 is new or was previously installed, and different commands can be programmed to control machine operation once this initial determination has been made.

Figure 6:
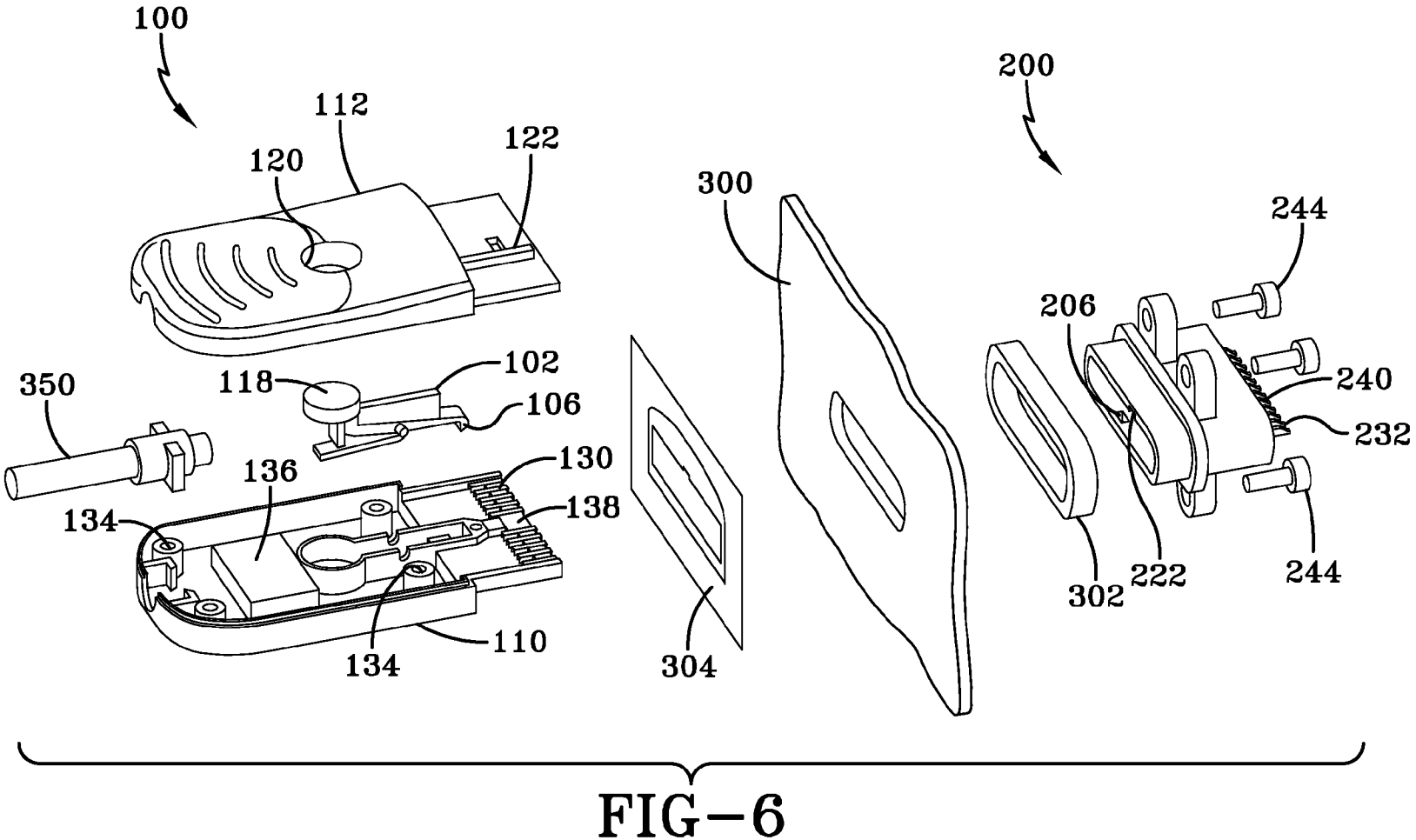
FIG. 6 is an exploded view of the plug connector and the receptacle, including the instrument panel.

FIG. 6 is an exploded view of the plug connector 100 and the receptacle assembly 200 of FIGS. 1-5. FIG. 6 also depicts cable 350, which is assembled to plug connector, as well as equipment panel 300. FIG. 6 may also include a panel label 304 affixed to panel 300 to provide any relevant identification information, instructions and/or warnings to the user. Of course, the label 304 also may be used to additionally provide the user with a visual orientation aid for insertion of the plug connector by providing the plug connector 100 with visual information that can be matched to label 304. The information on label 304 and plug connector 100 can be written, shape and/or color information that matches the plug connector 100 to label 304, thereby providing additional visual orientation guidance to the user for inserting plug connector 100 to receptacle 200.

Figure 7:
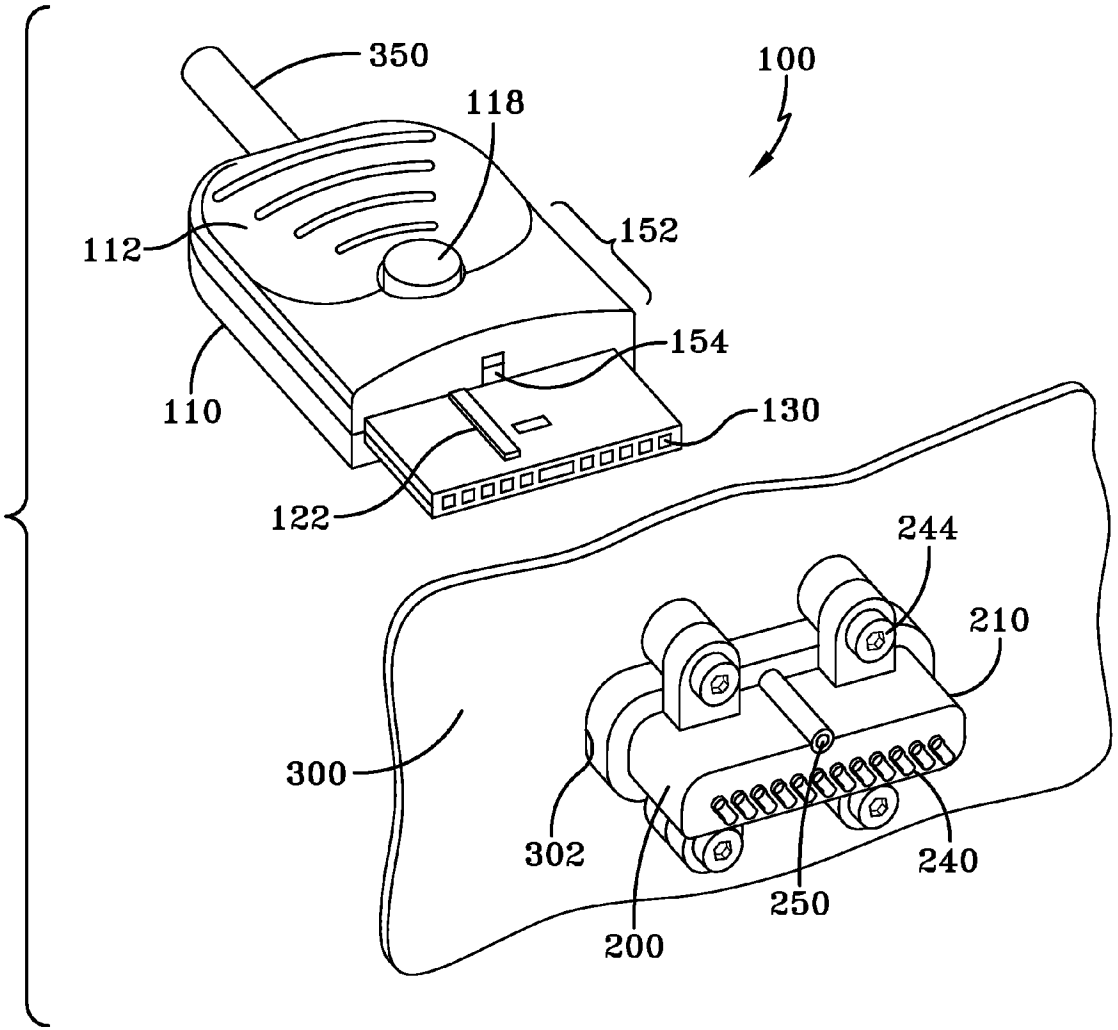
FIG. 7 is a view of an embodiment of the plug connector/receptacle combination having light transmission capabilities.

FIG. 7 provides yet another embodiment of plug connector/receptacle assembly 10 of the invention described in FIGS. 1-6. In this embodiment, receptacle 200 includes all of the features previously described and further includes a port for lighting 250, while plug connector 100 includes all of the features previously described and further includes an optional light path 154. Light port 250 offers a means of lighting receptacle 200 when the equipment is energized. The light source, may be LED, that is included in receptacle 200 or may be a light pipe transmitting light generated by a light source external to receptacle 200, such as in the equipment. Optionally a portion of plug 100, such as front portion 152 of cover 112 comprises a transparent cover or a translucent cover that can be molded of clear or semi-clear plastic. While the housing may be of any shape, it is preferred that the housing be molded into an ergonomic shape that can readily be handled with a single hand or in the palm of a hand. Of course, either or all of cover 112, housing of plug connector 100 or latch mechanism 102 may be molded from this material. Light transmitted by light pipe will be transmitted through a conduit, such as a window 154 into latching member 102, as shown in FIG. 7. The transmitted light will illuminate the interior of receptacle 200 and be transmitted through the translucent or transparent material, thereby illuminating latching member 102 and latch button surface 118 so that it is readily visible. This facilitates mating and unmating of plug connector 100 and receptacle 200. The receptacle connector 200 being visible, particularly in low light environments, such as for example, a darkened hospital room makes mating significantly easier. Button 118 being lighted also aids in disassembly. This lighting feature can also be used in a mode that permits the equipment to communicate with the user. A signal can be generated by the equipment causing a light to flash in a particular pattern indicative of a particular event or condition. Alternatively and equivalently, lights of multiple colors can be provided and a particular color can be activated to signify a particular event or condition.

These features, in combination or individually, provide a plug connector/receptacle assembly 10 that can be assembled by crimping instead of by soldering. The assembly can readily be positively mated by a combination of one or more features including mating shape features, color coding or other printed visual aids, and tactile features, to facilitate rapid mating in environments ranging from low light to situations of high stress. The connector/receptacle assembly may include use-limiting features, by providing either single use features, a feature that counts the number of uses or times the extent of a use. In addition, light features that assist in low light mating can also be used to communicate information to the user by providing appropriate lighted patterns or color combinations.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A plug connector, comprising a latching mechanism movable from a first engaged position to a second disengaged position, the latching mechanism further including a latch release surface, and a means for latching the mechanism to an opposed surface;

a plurality of metal contacts, each contact configured to accept a wire;

a housing to locate and align the plurality of metal contacts, the housing further including an exterior and an interior;

a passageway extending from the exterior of the housing to the interior of the housing;

a jumper contact movable from a first position to a second position when the latching mechanism is in the first engaged position; and a means for capturing the jumper contact in the second position.

2. The plug connector of claim 1 wherein the latching mechanism further includes a latching arm with a projection extending downward from the latching arm, the downward-extending projection comprising the means for latching the mechanism to an opposed surface.

3. The plug connector of claim 1 further including one of a key and keyway for aligning the plug connector to a mating receptacle.

4. The plug connector of claim 1 wherein the means for capturing the jumper contact in the second position includes a surface having dimensional tolerances that interfere with the jumper contact, thereby capturing it in the second position.

5. The plug connector of claim 1 wherein the means for capturing the jumper contact is a depression in the housing sized to accept the jumper contact when the jumper contact is moved to a second position.

6. The plug connector of claim 1 wherein the means for capturing the jumper contact includes a jumper contact having a dimple and a raised block having a biased nipple that engages the dimple when the jumper contact is moved to the second position, thereby capturing the jumper contact in the second position.

7. The plug connector of claim 1 wherein at least one of the latching mechanism and a portion of the housing comprises a light-transmitting material.

8. The plug connector of claim 7 wherein the light-transmitting material is selected from the group consisting of a translucent material and a transparent material.

9. The plug connector of claim 8 further including a conduit to transmit light to the housing interior.

10. A plug connector/receptacle assembly, comprising a plug connector, including a latching mechanism movable from a first engaged position to a second disengaged position, the latching mechanism further including a latch release surface, and a means for latching the mechanism to an opposed surface;

a plurality of metal contacts, each contact having a first end and a second end, the first end of each contact configured to accept a wire;

a housing having a predetermined geometric configuration to locate and align the plurality of metal contacts, the housing further including an exterior and an interior, the exterior of the housing further including at least one of visual and tactile indicia to facilitate proper mating of the plug connector, a passageway extending from the exterior of the housing to the interior of the housing;

a jumper contact movable from a first position to a second position when the latching mechanism is in the first engaged position, and fixed metal contacts to move the jumper contact from the first position to the second position; and a means for capturing the jumper contact in the second position; and a receptacle, the receptacle having a predetermined geometric configuration that mates with the geometric configuration of the plug connector so that the plug connector is capable of unique mating to the receptacle and further including a plurality of metal spring contact probes, each metal spring contact probe having a first end and a second end, the first end of each metal spring contact probe configured to accept a wire and the second ends of the plurality of metal spring contact probes configured to mate with the second end of the plurality of metal contacts of the plug connector, a housing for locating and positioning the plurality of metal spring contact probes, the housing having a first end and a second end, the second end of the metal spring contact probes extending away from the second end of the housing, and a surface that includes means for locking the mating plug connector, the means for locking mating with the means for latching of the plug connector.

11. The plug connector/receptacle assembly of claim 10 wherein a light source is positioned within the receptacle.

12. The plug connector/receptacle assembly of claim 10 wherein the receptacle further includes a light pipe and the plug connector includes a light path.

13. The plug connector/receptacle assembly of claim 10 further including a key/keyway for locating the plug connector to the receptacle wherein the plug connector includes one of the key and keyway, and the receptacle includes the other of the key and keyway.

14. The plug connector/receptacle assembly of claim 10 further including a plurality of fixed metal contacts having a first end and a second end, the first end configured to accept a wire, the fixed metal contacts having a second length configured to mate with the jumper contact in its first position, wherein the fixed metal contacts and the jumper contact mate at a different time than the plurality of metal spring contact probes mate with the plurality of metal contacts of the plug connector.

15. The plug connector/receptacle assembly of claim 10 wherein at least one of the plug connector housing and the plug connector latching mechanism comprises a light transmitting material selected from the group consisting of a transparent material and a translucent material, and forms a portion of the light path that illuminates the plug connector with light received from the light source.

16. The plug connector/receptacle assembly of claim 15 wherein a light pipe in the light path transmits light from an external source through the receptacle to the plug connector.

* * * * *